US010981177B2

(12) United States Patent
Bohm et al.

(10) Patent No.: US 10,981,177 B2
(45) Date of Patent: Apr. 20, 2021

(54) APPARATUS AND METHOD FOR PRODUCING FLOUR AND/OR SEMOLINA

(71) Applicant: BÜHLER A.G., Uzwil (CH)

(72) Inventors: Arturo Bohm, Oberuzwil (CH); Kurt Grauer, Dergersheim (CH); Urs Dübendorfer, Niederuzwil (CH)

(73) Assignee: BÜHLER AG, Uzwil (CH)

( * ) Notice: Subject to any disclaimer, the term of this patent is extended or adjusted under 35 U.S.C. 154(b) by 431 days.

(21) Appl. No.: 14/750,276

(22) Filed: Jun. 25, 2015

(65) Prior Publication Data

US 2015/0321196 A1 Nov. 12, 2015

Related U.S. Application Data

(62) Division of application No. 13/001,994, filed as application No. PCT/EP2009/058345 on Jul. 2, 2009, now Pat. No. 9,067,213.

(30) Foreign Application Priority Data

Jul. 2, 2008 (DE) ..... 10 2008 040 091.2
Jul. 2, 2008 (DE) ..... 10 2008 040 100.5
Oct. 23, 2008 (DE) ..... 10 2008 043 140.0

(51) Int. Cl.
*B02C 4/06* (2006.01)
*B02C 4/38* (2006.01)
(Continued)

(52) U.S. Cl.
CPC ..... *B02C 23/12* (2013.01); *B02C 4/06* (2013.01); *B02C 4/38* (2013.01); *B02C 9/04* (2013.01); *B07B 4/04* (2013.01); *B07B 9/02* (2013.01)

(58) Field of Classification Search
CPC .. B02C 23/12; B02C 4/06; B02C 4/38; B02C 9/04; B02C 9/02; B02C 11/04; B02C 4/16; B07B 4/04
See application file for complete search history.

(56) References Cited

U.S. PATENT DOCUMENTS 1,497,108 A 6/1924 Little
1,861,248 A 5/1932 Stebbins
(Continued)

FOREIGN PATENT DOCUMENTS

DE 118531 3/1901
DE 612639 4/1935
(Continued)

OTHER PUBLICATIONS

Whole Grains a to Z _ The Whole Grains Council; https://wholegrainscouncil.org/whole-grains-101/whole-grains-z.*
(Continued)

*Primary Examiner* — Gregory D Swiatocha
(74) *Attorney, Agent, or Firm* — Davis & Bujold PLLC; Michael Bujold

(57) ABSTRACT

A material bed roller mill for comminution of grain in a material bed. The material bed roller mill comprises rollers, at least one feed opening, a draw-in region between the rollers, a grinding gap between the rollers and at least one delivery opening. The material bed roller is configured, during operation, to produce a material bed in the draw-in region and to draw grain from a surplus thereof by a filled material duct or hopper. A specific grinding force of the material bed roller mill can be set in such a way that grain is heated, during the grinding operation, by less than 30° C., preferably by less than 15° C., to the temperature of the grain before the respective grinding.

4 Claims, 6 Drawing Sheets

Figure 2:
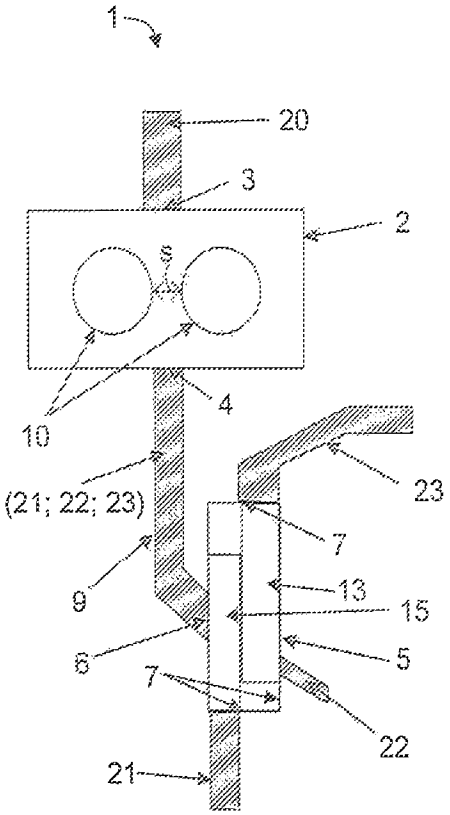

(51) Int. Cl.

| | |
|---|---|
| ***B02C 9/04*** | (2006.01) |
| ***B07B 9/02*** | (2006.01) |
| ***B02C 23/12*** | (2006.01) |
| ***B07B 4/04*** | (2006.01) |

(56) References Cited

U.S. PATENT DOCUMENTS

| | | | | | |
|---|---|---|---|---|---|
| 2,221,802 | A | | 11/1940 | Keys | |
| 2,713,460 | A | | 7/1955 | Atkinson | |
| 2,984,423 | A | | 5/1961 | Roth | |
| 3,173,794 | A | | 3/1965 | Reckon | |
| 4,074,866 | A | | 2/1978 | Meder | |
| 4,089,478 | A | * | 5/1978 | Collie | B02C 4/06 241/167 |
| 4,154,408 | A | * | 5/1979 | Boling, Jr. | B02C 4/32 241/231 |
| 4,339,083 | A | * | 7/1982 | Linzberger | B02C 4/38 241/232 |
| 4,357,287 | A | | 11/1982 | Schonert | |
| 4,636,305 | A | | 1/1987 | Mueller | |
| 4,703,897 | A | * | 11/1987 | Beisner | B02C 23/32 241/24.1 |
| 4,728,044 | A | | 3/1988 | Duill et al. | |
| 4,783,011 | A | | 11/1988 | Blasczyk et al. | |
| 4,806,235 | A | | 2/1989 | Mueller | |
| 4,840,315 | A | * | 6/1989 | Rubin | B02C 21/00 241/24.1 |
| 4,905,910 | A | * | 3/1990 | Wuestner | B02C 4/42 241/101.2 |
| 5,050,808 | A | * | 9/1991 | Satake | B02C 4/32 241/101.3 |
| 5,054,694 | A | | 10/1991 | Knobloch et al. | |
| 5,088,651 | A | * | 2/1992 | Takahashi | B02C 4/02 241/101.2 |
| 5,096,131 | A | * | 3/1992 | Patzelt | B02C 4/286 241/224 |
| 5,104,671 | A | | 4/1992 | Wellman | |
| 5,154,362 | A | | 10/1992 | Knobloch et al. | |
| 5,310,123 | A | | 5/1994 | Baltensperger et al. | |
| 5,333,798 | A | | 8/1994 | Paliard et al. | |
| 5,351,832 | A | | 10/1994 | Abbott et al. | |
| 5,375,776 | A | | 12/1994 | Kupper et al. | |
| 5,411,142 | A | | 5/1995 | Abbott et al. | |
| 5,474,238 | A | | 12/1995 | Reichmuth | |
| 5,485,965 | A | | 1/1996 | Hostettler et al. | |
| 5,673,862 | A | * | 10/1997 | Wingler | B02C 7/11 241/259.1 |
| 5,678,777 | A | * | 10/1997 | Satake | B02C 4/06 241/227 |
| 5,798,917 | A | | 8/1998 | Werbrouck | |
| 5,876,648 | A | * | 3/1999 | Strasser | B02C 4/02 264/115 |
| 5,897,063 | A | | 4/1999 | Patzelt et al. | |
| 6,019,299 | A | | 2/2000 | Mitsuda et al. | |
| 6,550,700 | B1 | | 4/2003 | Griebat et al. | |
| 6,685,118 | B1 | | 2/2004 | Williams, Jr. | |
| 7,882,160 | B2 | | 2/2011 | Adams, III et al. | |
| 2002/0074435 | A1 | * | 6/2002 | Kasada | B02C 4/06 241/143 |
| 2005/0072273 | A1 | | 4/2005 | Burchardt et al. | |
| 2005/0284971 | A1 | | 12/2005 | Hagedorn et al. | |
| 2006/0195823 | A1 | | 8/2006 | Bentolila | |
| 2008/0296422 | A1 | | 12/2008 | Batz et al. | |
| 2009/0236455 | A1 | * | 9/2009 | Strasser | B02C 4/286 241/224 |
| 2010/0032506 | A1 | | 2/2010 | Patzelt | |
| 2010/0114997 | A1 | | 5/2010 | Micic et al. | |
| 2010/0127110 | A1 | | 5/2010 | Hagedorn et al. | |
| 2010/0161687 | A1 | | 6/2010 | Altrichter et al. | |
| 2010/0205230 | A1 | | 8/2010 | Simeonov et al. | |
| 2010/0219278 | A1 | | 9/2010 | Hagedorn et al. | |
| 2010/0229156 | A1 | | 9/2010 | Fink et al. | |
| 2012/0067989 | A1 | | 3/2012 | Hagedorn et al. | |
| 2014/0084092 | A1 | | 3/2014 | Braun et al. | |
| 2014/0252141 | A1 | | 9/2014 | Weinmann et al. | |

FOREIGN PATENT DOCUMENTS

| | | | | | |
|---|---|---|---|---|---|
| DE | 1211901 | | | 3/1966 | |
| DE | 1 270 380 | | | 6/1968 | |
| DE | 1 407 846 | | | 4/1969 | |
| DE | 76 06 402 | | | 6/1977 | |
| DE | 27 08 053 | | | 9/1978 | |
| DE | 3 410 573 | | | 10/1985 | |
| DE | 43 20 362 | A1 | | 12/1994 | |
| DE | 43 34 904 | A1 | | 4/1995 | |
| DE | 44 14 367 | A1 | | 10/1995 | |
| DE | 19 732 107 | A1 | | 2/1999 | |
| DE | 19 757 431 | A1 | | 6/1999 | |
| DE | 19757431 | A1 | * | 6/1999 | B02C 4/286 |
| DE | 198 19 614 | A1 | | 11/1999 | |
| DE | 19829450 | A1 | * | 1/2000 | B02C 4/28 |
| DE | 10235241 | A1 | * | 11/2003 | B02C 21/00 |
| DE | 10 338 430 | A1 | | 3/2005 | |
| DE | 10 2006 054 598 | A1 | | 5/2008 | |
| EP | 0 037 066 | | | 10/1981 | |
| EP | 0 273 198 | | | 7/1988 | |
| EP | 0 285 921 | | | 10/1988 | |
| EP | 0 335 925 | B1 | | 10/1989 | |
| EP | 0 406 591 | A2 | | 1/1991 | |
| EP | 0 433 498 | A1 | | 6/1991 | |
| EP | 0 468 774 | A2 | | 1/1992 | |
| EP | 4 239 602 | A1 | | 5/1994 | |
| EP | 0 686 065 | A1 | | 12/1995 | |
| GB | 468212 | | | 6/1937 | |
| GB | 739562 | | | 11/1955 | |
| JP | 32-9364 | | | 11/1957 | |
| JP | 60175556 | | | 9/1985 | |
| JP | S60175556 | A | * | 9/1985 | B02C 9/04 |
| JP | 414172 | | | 2/1992 | |
| JP | 448500 | | | 8/1992 | |
| JP | 06205998 | | | 7/1994 | |
| JP | 07185383 | | | 7/1995 | |
| JP | 2710039 | B2 | | 2/1998 | |
| JP | 1176841 | | | 3/1999 | |
| JP | 2003290673 | A | | 10/2003 | |
| JP | 3126696 | | | 10/2006 | |
| JP | 2007104962 | | | 4/2007 | |
| KR | 20030037287 | A | | 5/2003 | |
| WO | 01/32311 | A1 | | 5/2001 | |
| WO | 2006/108577 | A1 | | 10/2006 | |

OTHER PUBLICATIONS

Google Conversion Feb. 4, 2019 (Year: 2019).*
Machine translation of DE10235241, Translated Dec. 3, 2019, 9 Pages. (Year: 2003).*
Machine translation of DE19829450, Translated Dec. 3, 2019, 5 Pages. (Year: 2000).*
Karlsson, Johan. "Automatic control of a roller mill using simulations and experiments on a real machine." 2008 (Year: 2008).*
Korean Office Action issued in corresponding Korean Patent Application No. 10-2016-7032029 dated Jan. 4, 2017.
"Prinzipien and neuere Verfahren der Windsichtung" [Principles and newer methods of air separation] by H. Rumpf and K. Leshonski (CIT 39 (1967) 21, 1261 ff.), Elsevier B.V., (English abstract).
Korean Office Action issued in corresponding Korean Patent Application No. 10-2010-7029796 dated Sep. 14, 2015.

* cited by examiner

APPARATUS AND METHOD FOR PRODUCING FLOUR AND/OR SEMOLINA

The present invention relates to the field of the production of flour and/or semolina from grain, having the features of the preambles of the independent claims.

A method and an apparatus for producing ground grain products, such as, for example, flour, semolina or middlings, according to the principle of advanced milling is disclosed by EP 0 335 925 B1. Here, the ground product is repeatedly ground, preferably twelve to twenty times, between rollers and is repeatedly sieved. In this case, the ground product is directed at least twice via double roller grinding stages without sieving between the individual stages of the double grinding and is sieved in each case following the double grinding.

These previously known apparatuses and methods have in this case the disadvantage that the material to be ground is greatly heated in the grinding arrangements during the grinding operation. This is especially disadvantageous when grinding grain into flour, since the proteins present in the grain are changed or damaged by the heat introduced into the grain. In particular, gluten is changed by the introduced heat, since gluten is thermolabile. Since gluten has a very great effect on the quality of a loaf of bread baked with the flour, changes in the gluten due to the grinding process lead to changes in the bread quality, which have to be compensated for, for example in a bakery, during the process of producing a loaf of bread from the flour produced.

A further disadvantage of the previously known method and of the apparatus for producing flour from grain is the need to use a plurality of sequential grinders for the flour production, since said grinders are costly and the operation thereof requires large amounts of energy. In addition, the use of a plurality of grinders means that large buildings are required for the mill, which further increases the costs for setting up a mill.

In addition, the previously known method and the apparatus have the disadvantage that the power required for producing flour and/or semolina from grain is considerable. For example, in the prior art, at least 25 to 27 kWh/t or even more than 33 kWh/t is required for producing flour of common fineness, i.e. common particle size.

DE 27 08 053 discloses a method for the fine and very fine comminution of ores by means of a material bed roller mill, this comminution being effected under high compressive stress, but in a limited manner for protecting from excessive compressive stresses and pressure peaks.

One object of the present invention is therefore to avoid the disadvantages of the known prior art, that is to say in particular to provide an apparatus and a method with which flour can be produced from grain with a lower input of heat during the grinding operation. Another object of the present invention is to provide an apparatus and a method with which flour can be produced from grain cost-effectively and in a favorable manner in terms of energy.

These objects are achieved by an apparatus and a method according to the characterizing part of the independent claims.

The apparatus according to the invention relates to a grinding arrangement for producing flour from grain, said grain being in particular bread wheat, durum wheat, maize or buckwheat. The grinding arrangement is characterized by at least one grinder which is designed in particular as a material bed roller mill. The grinder has at least one feed opening and at least one delivery opening. The grinding arrangement comprises at least one separating stage for separating ground products into finer ground product and coarser ground product and a return arrangement for returning at least some of the coarser ground product into the feed opening of the grinder.

Bread wheat is also referred to as *Triticum aevastivum* and durum wheat as *Triticum durum*.

Within the scope of the invention, rice is also regarded as grain.

Roller mills usually have two rollers which rotate at different speeds and between which a roller gap and thus a grinding force can be set, grain, for example, being transported through said roller gap and thus being ground. The degree of grinding, i.e. the particle size of the ground product to be achieved, is determined in particular by the size of the roller gap. The roller gap remains constant during the grinding operation. A grain to be ground is fed into this roller mill. In order to be able to grind grain using such a roller mill, the roller gap has to be set to the particle size of the grain. During such grinding, a considerable amount of heat is introduced into the grain by the mechanical grinding process and the pressure in the roller gap, in particular at small roller gap widths, and therefore the grain is heated to a considerable extent. Since the grain is fed into the roller mill, i.e. in particular as individual particles, the throughput in the case of a small roller gap, that is to say in particular in the final so-called fine grinding stages, is very small.

A material bed roller mill within the scope of the present application refers to a force-controlled roller mill. For example, mechanically preloaded springs or hydraulically coupled gas accumulators are used for generating force. A pressure is exerted on the rollers in the direction of the roller gap, such that a roller gap is set between these rollers as a function of the quantity and the type of grain to be ground in the roller gap and as a function of the set pressure. For example, a gap of about 0.5° to 2% of a roller diameter can be set. The resulting grinding gap is thus obtained when the grain is being drawn in, which in particular is dependent upon friction, by the rollers. In the process, some of the particles can be larger than the gap. Typically, however, the particles are smaller than the resulting gap. A material bed is produced in the draw-in region between the rollers when the material bed roller mill can draw in the grain from a surplus thereof, e.g. by means of a filled material shaft or funnel. The material bed comminution is based on a packed particle fill in the grinding gap. The setting of the grinding force serves to control the input of energy at the mill. The input of energy determines, depending on material and grain size, the production of finer ground product in the material and is to be set to an optimum range.

In particular, the throughput through a material bed roller mill is dependent, for example, upon the rotary speed of the rollers. A higher rotary speed generally leads to a higher throughput. For example, peripheral speeds of the rollers, i.e. the speed at the surface which is in engagement with the grain during the grinding operation, can be within the range of 1 m/s to 1.5 m/s, in particular less than 1 m/s and most particularly less than 0.1 m/s. Smaller peripheral speeds are generally set for finer ground products.

If the drawing-in of grain into the material bed roller mill is insufficient, for example on account of a lack of friction, such that fluidization phenomena occur, a compactor, e.g. a compactor screw, can be used, and this compactor conveys the grain into the roller gap, assisting the gravitational force for example.

The material bed roller mill is therefore characterized by a variable roller gap during the grinding, by setting of the pressure in the roller gap and by virtue of the fact that an increase in the grain volume in the roller gap leads to an increase in the roller gap.

The rollers of the material bed roller mill advantageously rotate at different speeds. This leads to intensified shearing of the grain in the roller gap and as a result to improved grinding into bran and semolina.

Within the scope of the application, bran also refers to a mixture of bran and husk parts of the grain.

A separating stage within the scope of the present invention means an apparatus for separating grain into various sizes, shapes or densities, wherein separation can take place either on the basis of one of these parameters or on the basis of any desired combination of these parameters. Separation can be effected, for example, first into various particle sizes of the ground grain. After that, for example, further separation into various densities of the particles of a size range is possible. For example, the ground grain can be separated in a first step into particles having particle sizes of 280 μm up to 560 μm and particles having a particle size of 560 μm up to 1120 μm. In a second stage, for example, the particles from the size range of 280 μm up to 560 μm can then be sorted according to the density and/or the shape of the particles, whereas the particles from the size range of 560 μm up to 1120 μm are ground a second time.

The expression that a ground product is separated into finer ground product and coarser ground product refers within the scope of the present application to relative separation according to particle sizes of the ground product. For example, during separation of a ground product into particles having particle sizes of 100 μm up to 200 μm and of 200 μm up to 300 μm, i.e. into two fractions, the ground product within the first size range is the finer ground product and the ground product within the second size range is the coarser ground product. Separation into two, three, four or even more fractions is also possible.

The grinding arrangement according to the invention has the advantage that the return of at least some of the coarser ground product into the feed opening of the grinder by means of the return arrangement leads to a reduction in the number or requisite grinders for achieving a defined degree of grinding, i.e. a particle size to be achieved, after the grinding operation, since the ground product is directed through the grinder again until the defined degree of grinding is achieved. This leads to a more cost-effective grinding arrangement compared with the prior art, since the number of grinders and the overall size of the entire grinding arrangement are reduced.

A further advantage of the grinding arrangement, in particular when using a material bed roller mill, is the selective grinding of the grain in the grinder, i.e. the bran is not ground to the same extent as the flour body, also called endosperm. In other words, the bran retains a larger particle size than the ground flour body, as a result of which said bran and said flour body can be more easily separated in a separating stage.

The returned ground product is mixed with grain that is not yet ground, for example before the grinding operation again in the grinder, such that a throughput of the mixture of grain and returned ground product in the grinder can be kept as constant as possible. This can be achieved, for example, by a regulating mechanism for the grain that is not yet ground.

A specific grinding force of the grinder can preferably be set in the grinding arrangement in such a way that grain is heated during the grinding operation by less than 30° C. relative to the temperature of the grain before the respective grinding. The grain is heated preferably by less than 15° C., particularly preferably by less than 10° C. and most particularly preferably by less than 5° C.

A specific grinding force S refers within the scope of the present application to the ratio of the pressure exerted in the direction of the grain, i.e. the contact force F, roller diameter D and the effective roller length L coming into engagement with the grain, according to the formula $S=F/LD$.

The adjustability of the specific grinding force of the grinder in such a way that the heating of the grain by the grinding operation is limited has the advantage that the change in or damage to the proteins, in particular the gluten in the grain, is reduced. This leads to enhanced reproducibility of properties of the flour produced according to the present invention. In special applications, for example, cooling of the rollers, of the grain or of the rollers and the grain can also be provided.

The specific grinding force is therefore advantageously set in such a way that the desired grinding result is achieved, i.e. production of a high proportion of finer ground product, without the grain being heated too strongly during the grinding operation. As a result, the energy consumed by the grinding plant is reduced compared with the prior art, since the grain is heated less strongly.

A grinding gap between two rollers of the grinder of the grinding arrangement is also preferably variable at a constant specific grinding force on the grain which can be introduced into the roller gap.

In this case, it is also possible to make the specific grinding force adjustable or controllable manually or by means of an open-loop or closed-loop control apparatus, e.g. as a function of the particle size, of the number of particles produced and of the heating of the grain.

The exertion of a constant specific grinding force on grain in the roller gap has the advantage that the grain is ground under constant conditions, i.e. with substantially constant input of heat into the grain by the grinding operation. This is achieved by the roller gap between the two rollers of the grinder being variable, such that, for example during an increase in the quantity of grain in the roller gap, the latter is increased and therefore the specific grinding force exerted on the grain remains constant. In the event of the quantity of grain in the roller gap being reduced, the roller gap is also reduced and the specific grinding force exerted on the grain remains constant.

However, it is also possible for the specific grinding force to increase in a defined manner when the roller gap is enlarged. This is achieved, for example when using a mechanically preloaded spring for generating force, by an increase in the roller gap leading to further extension of the spring and thus by an increased specific grinding force being set on account of the characteristic of the spring. Since the throughput through the roller gap is increased, with at the same time an increase in the specific grinding force, an input of energy per grain quantity remains approximately constant, such that the grinding conditions likewise remain constant here. If the roller gap is reduced, the specific grinding force correspondingly decreases, such that, here too, an input of energy per grain quantity remains approximately constant.

In a completely surprising manner, it has now been shown that, despite the protective grinding of the grain by limiting the input of heat into the grain compacted in the roller gap, the starch cores, i.e. the main constituent of the endosperm, are damaged. This damage can in particular be set, for example by setting the specific grinding force or also conditioning the grain.

The separating stage of the grinding arrangement is in particular preferably configured in such a way that grain having a density of less than 2 g/cm$^3$ and in particular less than 1.5 g/cm$^3$ can be separated into finer ground product and coarser ground product. In this case, the ground products have a density of less than 2 g/cm$^3$ and in particular less than 1.5 g/cm$^3$.

This has the advantage that the separating stage is adapted to the separation of grain into finer and coarser ground products and therefore better separation according to the density of the ground product is made possible. This is possible, for example, in separating stages which achieve the separation by means of air flows by the geometry of the separating stage and the air flow being adapted precisely to the density range of the material.

Furthermore, a specific grinding force of less than 3 N/mm$^2$ is particularly preferably set in the grinding arrangement. This specific grinding force is preferably less than 2 N/mm$^2$, particularly preferably between 1 N/mm$^2$ and 2 N/mm$^2$ and most particularly preferably less than 1 N/mm$^2$.

This limiting of the specific grinding force has the advantage that the heat introduced into the grain by the grinding operation is further reduced, such that damage to or changes in the proteins, in particular gluten, are further reduced.

Furthermore, the separating stage of the grinding arrangement most particularly preferably comprises at least one apparatus from the list of the following apparatuses: zigzag sifter, semolina purifier, plan sifter, turbo sifter, distribution plate separator, crossflow separator. The separating stage comprises preferably two of these apparatuses, particularly preferably at least two of these apparatuses.

Zigzag sifters are known from the prior art, for example from GB 468 212 and DE 19 732 107 C2 or from the textbook "Prinzipien and neaere Verfahren der Windsichtung" [Principles and newer methods of air Separation] by H. Rumpf and K. Leshonski (CIT 39 (1967) 21, 1261 ff.).

Semolina purifiers are known from the prior at, for example according to DE 612 639 C1, DE 34 10 573 A1 or the textbook "Maschinenkunde für Müller" [Machinery for millers] by A. W. Rohner (1986) and are obtainable, for example, from Bühler A G.

Plan sifters, which are designed as sieving apparatuses, are likewise known from the prior art, for example from the textbook "Maschinenkunde für Müller" [Machinery for millers] by A. W. Rohner (1986) and are obtainable, for example, from Bühler A G.

Turbo sifters are likewise known from the prior art, for example from the textbook "Handbuch der Verfarhrenstechnik" [Process engineering manual] by H. Schubert (Wiley-Verlag) and are offered, for example, by Hosokawa Alpine AG, Augsburg, in the Turboplex or Statoplex ranges.

This construction of the separating stage comprising at least one of the apparatuses described above has the advantage that, for the respective separation according to particle size, particle shape or density, the respectively suitable apparatus, i.e. zigzag sifter, semolina purifier, plan sifter, turbo sifter, can be integrated into the separating stage. For example, for two-stage separation, separation can be carried out first according to particle size and after that according to the density of the particles. A plan sifter, for example, is used for the first separating stage and a zigzag sifter or a semolina purifier, for example, is used for the second separating stage. In this case, the grain is first separated into finer and coarser ground products using the plan sifter and, for example, the finer ground product is thereupon separated into constituents of different densities by means of a zigzag sifter, that is to say in particular into semolina and bran. It is also possible for the plan sifter to separate the grain into a plurality of fractions and for these fractions, that is to say the coarser ground product too, to then each be conveyed into a separate zigzag sifter in which said fractions are separated according to shape and/or density.

Semolina within the scope of the application means ground grain having a small proportion of bran, i.e. substantially pure semolina.

However, it is also possible in particular for a separating stage to comprise a plan sifter and two or at least two zigzag sifters arranged one after the other.

The grinding arrangement preferably has two grinders. In particular, the grinding arrangement has three grinders, particularly preferably four grinders and most particularly preferably at least four grinders.

This has the advantage that, for example, grinders of identical construction can be arranged sequentially one after the other, and the grinding force for the grinding result to be achieved can in each case be set individually in each grinder. Furthermore, for example, grinders of different types of construction, i.e. a material bed roller mill and a roller mill having a constant roller gap, can also be combined.

In particular, the grinding arrangement preferably has two separating stages. This grinding arrangement preferably has three separating stages, particularly preferably four separating stages and most particularly preferably at least four separating stages.

This has the advantage that, for example, if the grinding arrangement has a plurality of grinders, a separating stage can be arranged downstream of each of these grinders. Furthermore, it can be advantageous for two separating stages to be arranged sequentially and for each of these separating stages to carry out separation of the ground product according to different parameters.

Furthermore, a flow-based separating stage, in particular with air flows, is most particularly preferably designed as a partly circulating-air or circulating-air separating stage, in particular containing a zigzag sifter.

This has the advantage that at least some of the air which flows through the separating stage for separating the ground product, for example according to density, i.e. separation for example into semolina and bran, is returned into the separating stage again. This leads to a reduction in the energy consumed by the separating stage since, because inter alia, the air consumed by the separating stage is reduced as a result.

In a further preferred embodiment, the grinding arrangement comprises at least one separating stage for the separate discharge of bran from the finer ground product.

This has the advantage that the bran still located, for example, in the finer ground product is removed, which is especially advantageous for the production of white flour.

In an alternative preferred embodiment, the grinder has at least one roller type according to the following list: smooth rollers, fluted rollers, profiled rollers. Profiled rollers have, for example, a defined surface roughness.

This has the advantage that the grinder can be adapted to the grain to be ground in each case and to the grinding result to be achieved. Here, it is possible for the grinder to have two smooth rollers and two fluted rollers or else also a combination of smooth, profiled and fluted rollers.

A conditioning apparatus can preferably be connected upstream and/or downstream of at least one grinder of the grinding arrangement. With this conditioning apparatus, at least one of the following parameters of the grain can be set: temperature, moisture, particle size, proportion of bran.

This has the advantage that the grain is conditioned before and/or after the grinding in the grinder in such a way that an optimum grinding result can be achieved for the respective intended use. For example, the conditioning apparatus can be designed as a grist stage in which the grain is ground by a roller mill having a constant roller gap. In the process, a ground product of bran and endosperm is produced. In the conditioning stage, some of the bran can now be separated, for example in a first step, and therefore the proportion of bran in the grain is set. Due to the setting of the grinder in the grist stage, the particle size of the grain can also be set, said grain then being conveyed into the following grinder.

The conditioning apparatus can also contain, for example, a plan sifter for separating various particle sizes or also a portion of the bran. In addition, the conditioning apparatus can also contain a temperature-regulating device for heating or cooling the grain before the grinding operation and a device for setting the moisture of the grain.

The grinding plant preferably has at least one sensor for measuring the ash content, the moisture, the temperature and/or the particle size of the ground grain, in particular of the finer ground product and/or of the coarser ground product. However, it is also possible to measure the temperature and/or the moisture of the air flowing out of the separating stage, for example out of the zigzag sifter, by means of this sensor. This at least one sensor is preferably contained in the separating stage.

This has, inter alia, the advantage that the ash content or also the moisture content of the separated ground product, i.e. of the finer ground product and/or of the coarser ground product, can be measured, for example, after the separation in the separating stage. After that, the ground product can be conditioned, for example in a conditioning apparatus, to achieve an optimum moisture content for the grinding.

A further advantage is the measurement of the temperature and/or of the moisture of the air flowing out of the separating stage. On account of this measurement, the separating stage for example, in particular the zigzag sifter, can now be adjusted to optimum conditions, i.e. optimum flow conditions for optimum separation, in the separating stage.

This sensor is in particular a near-infrared spectrometer, i.e. an NIR spectrometer, and/or a color sensor. The color sensor is in particular suitable for measuring the ash content of the ground product. The NIR spectrometer is in particular suitable for measuring the moisture of the ground product and/or of the air.

A further aspect of the invention relates to a method for producing flour from grain, preferably from bread wheat, durum wheat, maize or buckwheat. This method is carried out in particular with a grinding arrangement as described above. In a first method step, the grain is ground in a grinder, this grinder being in particular a material bed roller mill. This grinder has at least one feed opening and at least one delivery opening. The grain is ground in particular with such a specific grinding force that the grain is heated during the grinding operation by less than 30° C. relative to the temperature of the grain before the respective grinding. The grain is preferably ground with such a specific grinding force that the grain is heated during the grinding operation by less than 15° C., particularly preferably by less than 10° C. and most particularly preferably by less than 5° C. relative to the temperature of the grain before the respective grinding. The grain is ground in particular preferably with a specific grinding force of less than 3 $N/mm^2$, preferably less than 2 $N/mm^2$, particularly preferably between 1 $N/mm^2$ and 2 $N/mm^2$ and most particularly preferably less than 1 $N/mm^2$. In a further method step, the ground grain is conveyed into a separating stage by means of a conveying arrangement. In a further step, the ground grain is separated in the separating stage into finer ground product and coarser ground product. In particular, grain having a density of less than 2 $g/cm^3$, in particular less than 1.5 $g/cm^3$, is separated into finer ground product and coarser ground product, the ground products having a density of less than 2 $g/cm^3$, in particular less than 1.5 $g/cm^3$. In a next step, at least some of the coarser ground product is returned into the feed opening of the grinder by means of the return arrangement. Furthermore, finer ground product is discharged from the separating stage.

This method is preferably carried out with the apparatus described above and therefore has all the advantages of the apparatus that are described above.

Firstly, starch damage of the grain is preferably set by the selection of the specific grinding force during the grinding in the grinder. Secondly, the input of heat into the grain is limited by this corresponding setting of the specific grinding force.

The expression "starch damage" refers within the scope of the application to damage of the starch core in the endosperm, such that the latter, for example, can absorb water in a simpler manner or is also more easily accessible for enzymes.

This adjustability of the starch damage of the grain by selecting the specific grinding force has the advantage that the starch damage of the grain can be adapted to the respective market requirements. For example, high starch damage is required for bread making in Britain since high water absorption of the flour is required for bread making in Britain. In Asia, on the other hand, low starch damage is required, such that the flour absorbs less water, since many products in Asia are sold in the dry state and therefore, after the process for producing the product, the water repeatedly absorbed due to starch damage has to be removed again, which requires large amounts of energy and is therefore expensive.

The grain is particularly preferably ground at least up to 90% into finer ground product by means of two passes through the grinder. In particular, the grain is ground at least up to 90% into finer ground product by means of three passes, particularly preferably by means of four passes and most particularly preferably by means of at least four passes through the grinder.

This has the advantage that, when the proportion of 90% of finer ground product is achieved with few passes, the throughput through the grinding plant is increased, although a higher specific grinding force is necessary for this purpose. This leads to greater heating of the grain during the grinding and to higher starch damage of the grain. If the grinding plant is set in such a way that a plurality of passes through the grinder are necessary in order to achieve 90° finer ground product, the throughput through the same grinding plant is reduced, although the specific grinding force is lower for the same grain to be processed. As a result, lower starch damage of the grain and lower heating of the grain during the grinding operation are achieved.

In a method step, bran is most particularly preferably substantially separated from the vegetable ground product in the separating stage.

In particular, a further grinder is preferably connected downstream of the separating stage for the further grinding of the finer ground product.

This has the advantage that, after the separation of the finder ground product, said finer ground product can be ground in a separate grinder for producing, for example, special flours.

Furthermore, a further separating stage is preferably connected downstream of the first grinding stage for the further separation of the finer ground product.

This has the advantage that each separating stage can be set to the specific separation result. For example, the separating stages can have different degrees of separation sharpness with regard to the density of the particles to be separated.

Furthermore, a detacher is preferably connected downstream of at least one grinder for detaching the grain after the grinding in the grinder. This has the advantage that, with possible compression of the grain in the grinder, the ground product is detached into individual particles by the detacher and therefore separation into finer and coarser ground products in the separating stage is then made possible.

The detachers used in practice are preferably impact detachers. However, drum detachers, agitators or also attrition mills or friction mills are used.

At least one of the following parameters of the grain is most particularly preferably set in a conditioning apparatus before and/or after the grinding: temperature, moisture, particle size, proportion of bran.

In particular, the conditioning apparatus is designed as a grist stage.

An additional aspect of the present invention relates to a zigzag sifter which is suitable in particular for carrying out the method as described above. The zigzag sifter is configured in such a way that grain having a density of less than 2 g/cm$^3$ and in particular less than 1.5 g/cm$^3$ can be separated into finer ground product and coarser ground product. In this case, the ground products have a density of less than 2 g/cm$^3$ and in particular less than 1.5 g/cm$^3$.

These zigzag sifters are preferably used in the grinding arrangement described above and therefore have all the advantages of the zigzag sifter that are described above.

An additional alternative aspect of the invention relates to a material bed roller mill which is suitable in particular for carrying out the method as described above.

This material bed roller mill is preferably used in the grinding arrangement described above and therefore has all the advantages of the grinding arrangement that are described above.

Grain can preferably be ground into finer ground product and coarser ground product in the material bed roller mill. A specific grinding force is less than 3 N/mm$^2$, preferably less than 2 N/mm$^2$, particularly preferably between 1 N/mm$^2$ and 2 N/mm$^2$ and most particularly preferably less than 1 N/mm$^2$.

A further aspect of the present invention relates to the use of a material bed roller mill for producing flour and/or semolina from grain, in particular from bread wheat, durum wheat, maize or buckwheat.

The material bed roller mill is characterized by a variable roller gap during the grinding, by setting of the pressure in the roller gap and by virtue of the fact that an increase in the grain volume in the roller gap leads to an increase in the roller gap.

A further alternative aspect of the invention relates to the use of a zigzag sifter for separating grain, preferably bread wheat, durum wheat, maize or buckwheat. The grain is separated into finer ground product and coarser ground product after a grinding operation in a grinder.

Grain having a density of less than 2 g/cm$^3$, in particular less than 1.5 g/cm$^3$, is preferably separated into finer ground product and coarser ground product. The ground products have a density of less than 2 g/cm$^3$, in particular less than 1.5 g/cm$^3$.

The zigzag sifter is particularly preferably used for separating bran from a finer ground product and/or coarser ground product.

The invention is explained in more detail below with reference to exemplary embodiments for better understanding.

Figure 1:
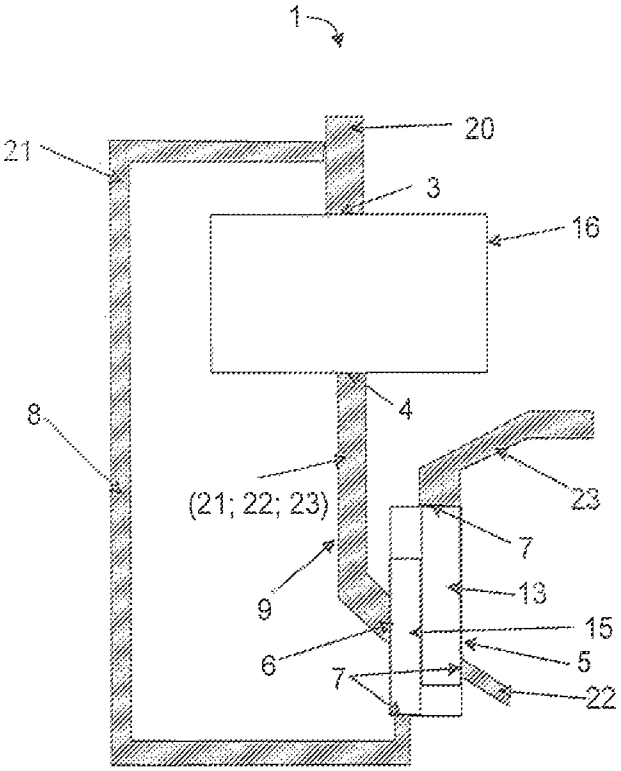
Figure 4:
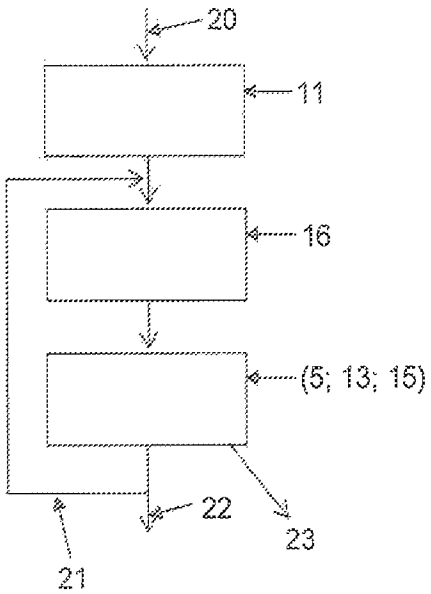
Figure 3:
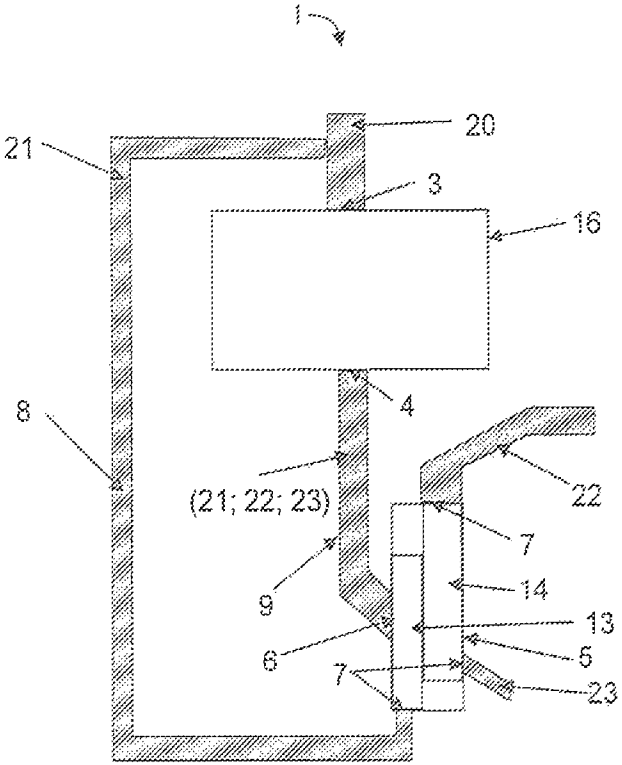
Figure 6:
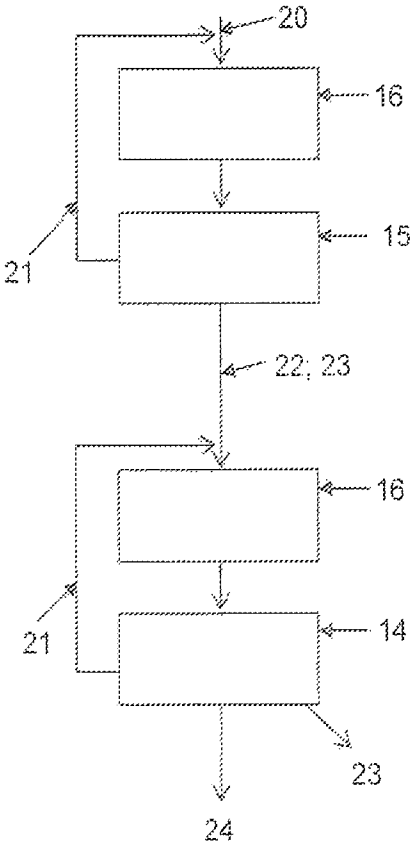
Figure 5:
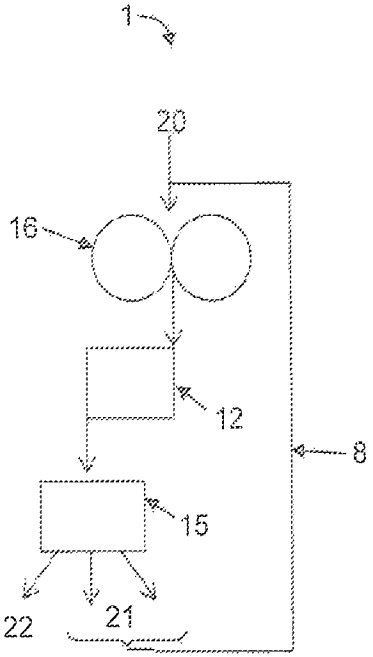
Figure 7:
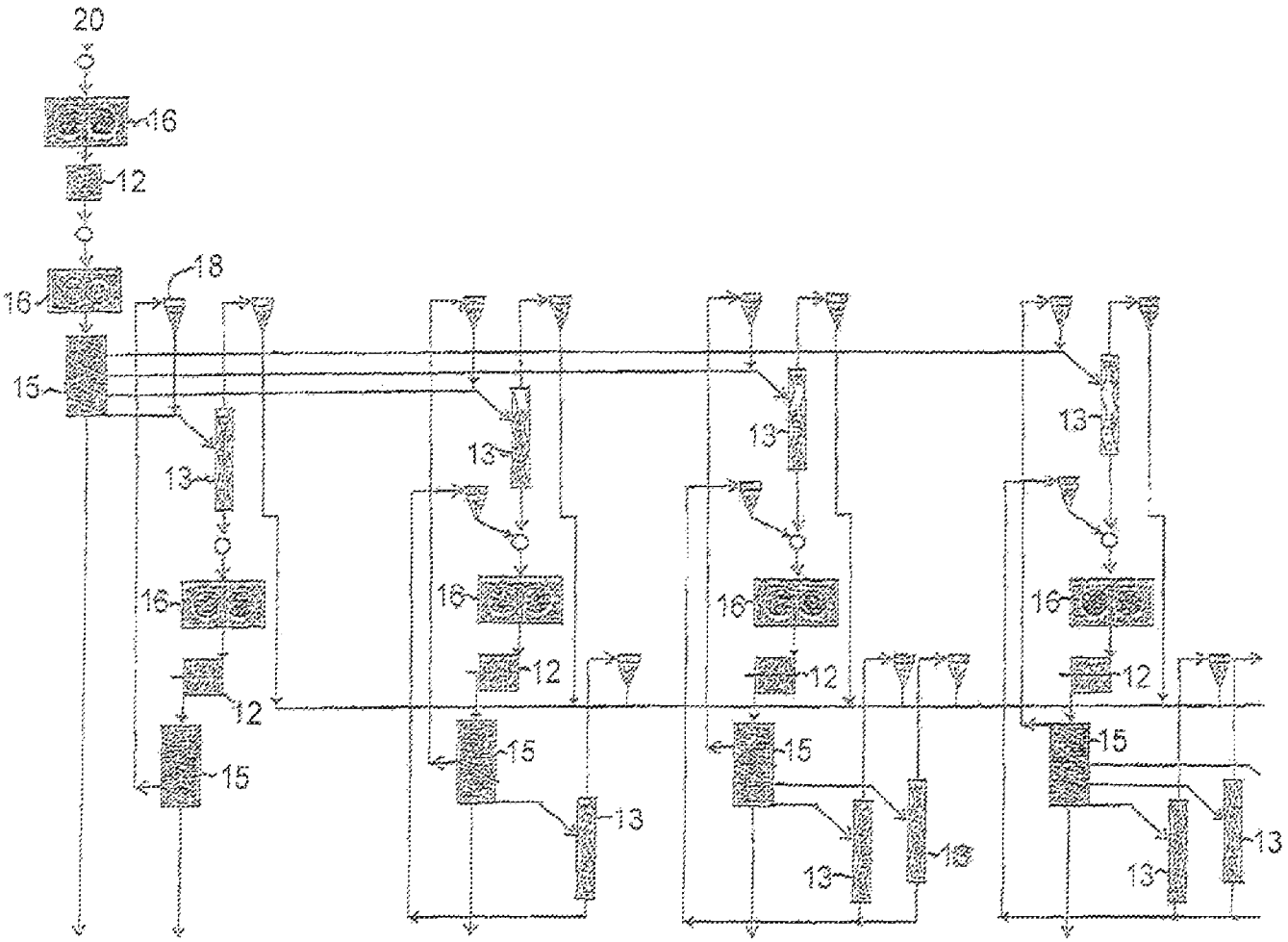
Figure 9:
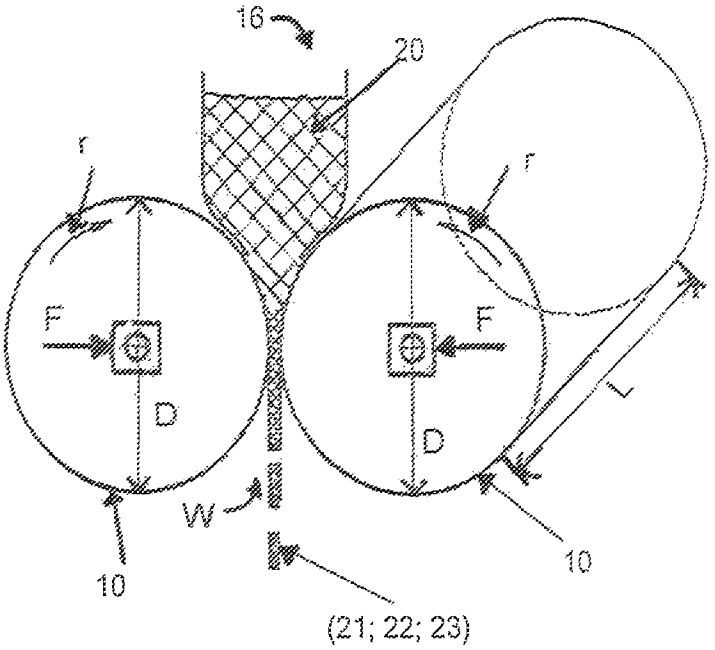
Figure 8:
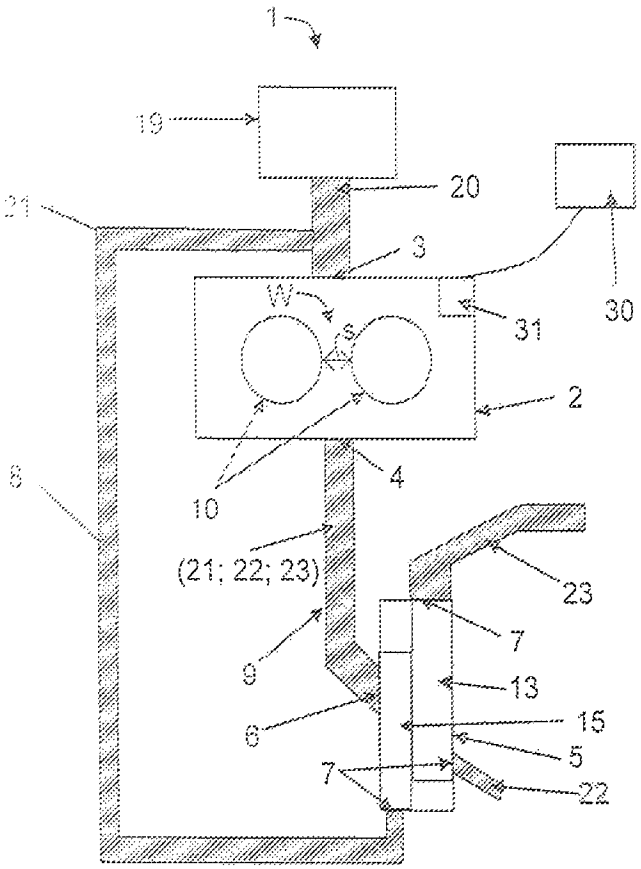
Figure 11:
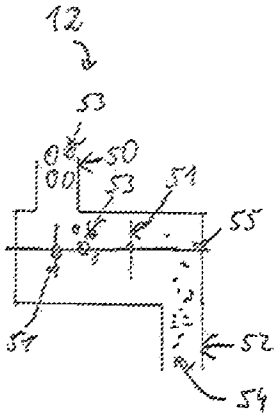
Figure 12:
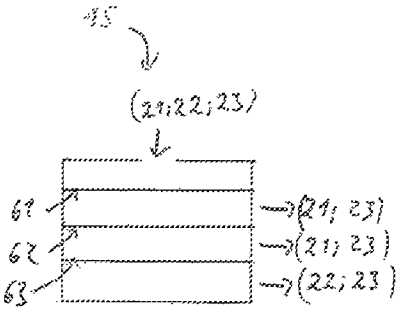
Figure 10:
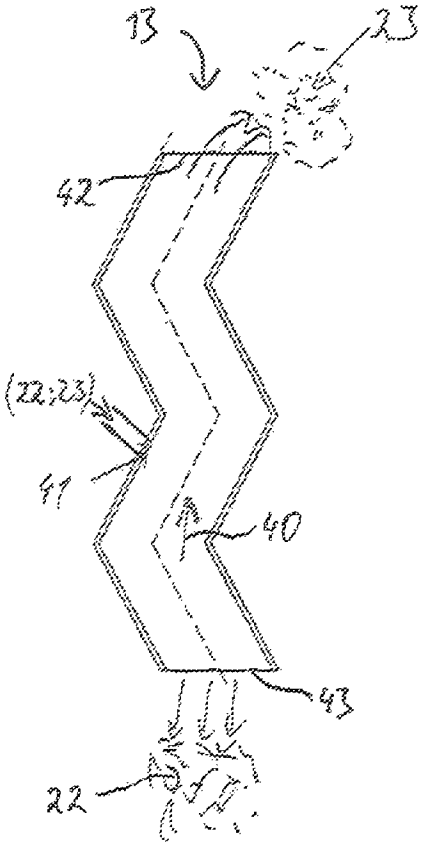

FIG. 1: a schematic illustration of an apparatus according to the invention having a material bed roller mill and a separating apparatus;

FIG. 2: a schematic illustration of an alternative grinding arrangement according to the invention having a roller mill and a separating apparatus;

FIG. 3: a schematic illustration of a further alternative apparatus according to the invention having a material bed roller mill and an alternative separating apparatus;

FIG. 4: a flow chart of a method according to the invention;

FIG. 5: a schematic illustration of an additional alternative apparatus according to the invention having a material bed roller mill and a detacher;

FIG. 6: a flow chart of an alternative method according to the invention;

FIG. 7: a schematic illustration of a mill diagram with material bed roller mill, detacher, plan sifter, zigzag sifter and cyclone separator;

FIG. 8: a schematic illustration of another alternative apparatus according to the invention having a roller mill with constant gap and computer control of the grain feed;

FIG. 9: a schematic illustration of a material bed roller mill with grain in the roller gap;

FIG. 10: a schematic illustration of a zigzag sifter;

FIG. 11: a schematic illustration of an impact detacher;

FIG. 12: a schematic illustration of a plan sifter.

FIG. 1 shows a schematic illustration of a grinding arrangement 1 according to the invention.

The grinding arrangement has, as grinder, a material bed roller mill 16, as shown, for example, in FIG. 9. The material bed roller mill 16 has a feed opening 3 and a delivery opening 4 for the grain 20. Furthermore, the grinding arrangement 1 has a separating apparatus 5 which has a zigzag sifter 13, for example according to FIG. 10, and a plan sifter 15, for example according to FIG. 12. Ground grain 20, which contains coarser ground product 21, finer ground product 22 and bran 23, is transported from the material bed roller mill 16 into the separating stage 5 by means of a conveying arrangement 9. Here, the rollers (not shown here) of the material bed roller mill 16 have a diameter of 250 mm. The conveying arrangement 9 is in this case designed as a gravity tube, such that the ground grain 20 is conveyed into the separating stage 5 by gravitational force. The separating stage 5 has an inlet opening 6 for receiving the coarser ground product 21, the finer ground product 22 and the bran 23. Furthermore, the separating stage 5 has three outlet openings 7, through which the coarser ground product 21, the finer ground product 22 and the bran 23 can be discharged separately in each case. The coarser ground product 21 is returned to the grinder 2 by means of the return arrangement 8. The return arrangement used here is a chain conveyor. Alternatively, however, the use of a bucket conveyor as return arrangement is also possible.

Grain 20 is transported through the feed opening 3 into the material bed roller mill 16, the grain 20 being ground in the material bed roller mill 16 into coarser ground product 21, finer ground product 22 and bran 23. To this end, a maximum specific grinding force of 1 N/mm$^2$ is set in the material bed roller mill 16, as a result of which a typical roller gap of between 1.25 mm and 5 mm forms as a function the quantity of grain 20 fed. The ground product is transported via the delivery opening 4 and the conveying arrangement 9 and through the inlet opening 6 into the separating stage 5. In the separating stage 5, the ground product is sorted in a first step according to size into coarser ground product 21 and a mixture of finer ground product 22 and bran 23. The plan sifter 15 is used for this purpose. The coarser ground product 21 is transported through one of the outlet openings 7 into the return arrangement 8 and is returned to the grinder 2 for grinding again. The mixture of finer ground product 22 and bran 23 located in the separating stage 5 is separated into bran 23 and finer ground product 22 by means of a zigzag sifter. The finer ground product 22 is discharged via the lateral outlet opening 7 and the bran 23 is discharged via the top outlet opening 7.

Here, the material bed grinding mills have rollers having a roller diameter of 250 mm and a length of 44 mm. A force of 22 kN is exerted on the rollers. The grinding is effected at a specific grinding force of 2 N/mm$^2$ with a roller gap of a thickness of 2 mm. Here, a flour yield in the ground product is 12.5%, approximately 5.3% of bran being separated with a zigzag sifter. The specific energy consumption at the mill is only 1.6 kWh/t; accordingly, about 12.8 kWh/t has to be consumed for the production of finished flour.

Here, the grain fed to the circuit has an ash content of 0.52%, the ash content of the flour produced being 0.47%.

FIG. 2 shows an alternative schematic illustration of a grinding arrangement 1 according to the invention. The same reference numerals in FIGS. 1 and 2 designate the same components here.

In contrast to the grinding arrangement, the grinding arrangement 1 according to figure has a grinder 2 having two rollers 10 which are at a fixed distance s apart. The fixed distance s can be set and is adapted to the grain size and can be, for example, 1 mm.

Here, in contrast to the method described with respect to FIG. 1, the coarser ground product 21 is not returned into the feed opening 3 of the grinder 2. For example, the coarser ground product 21 can be conveyed into a further grinder (not shown here).

FIG. 3 shows a further alternative schematic illustration of a grinding plant 1 according to the invention. The same reference numerals in FIG. 2 and FIG. 3 designate the same components here.

In contrast to the grinding plant 1 according to FIG. 2, the grinding plant 1 according to FIG. 3 has a separating apparatus 5 which comprises a zigzag sifter 13 and a semolina purifier 14. In the separating stage 5, the mixture of coarser ground product 21, finer ground product 22 and bran 23 is separated by means of the zigzag sifter 13 into coarser ground product 21 and a mixture of finer ground product 22 and bran 23. In a second step, the finer ground product 22 is separated from the bran 23 in the semolina purifier 14.

The method for grinding the grain 20 and for separating the ground product of coarser ground product 21, finer ground product 22 and bran 23 is otherwise effected substantially as described in FIG. 1.

FIG. 4 shows a flow chart of a method according to the invention. Grain 20 is transported into a conditioning apparatus 11, which contains a grist stage, and is pre-ground there into a mixture of bran 23 and semolina 21 or 22. In addition, the grain is regulated in the conditioning apparatus 11 to a temperature of 20° C. After this conditioning, the conditioned grain 20 is conveyed into a material bed roller mill 16 and is ground further here, wherein it is mixed, before the grinding, with coarser ground product 21 which is returned. In the process, the temperature increases during the grinding by less than 5° C. In other words, the temperature of the conditioned grain 20, which has a temperature of about 20° C. before the grinding, even after the mixing with the returned coarser ground product 21, is not heated above 25° C. during the grinding operation in the material bed roller mill 16. After the grinding in the material bed roller mill 16, the ground product is conveyed into a separating apparatus 5 which comprises a plan sifter 15 and a zigzag sifter 13. In this separating stage 5, the ground product is therefore separated into coarser ground product 21, finer ground product 22 and bran 23 and is discharged separately from the separating apparatus 5.

It is also possible for the grain to be cooled between the grinding stages or else for the rollers themselves to also be cooled. The combination of both cooling means is also possible.

FIG. 5 shows an additional alternative schematic illustration of a grinding arrangement 1 according to the invention. Grain 20 is conveyed into a material bed roller mill 16 and is ground therein. The grinding operation results in compaction of the ground product, and therefore in said ground product, before the separation in the plan sifter 15 into individual particle sizes, being conveyed into a detacher 12. Here, the detacher 12 is designed as an impact detacher, as shown in FIG. 11. The compacted ground product is substantially detached into the individual particles in this detacher 12 and is thereupon conveyed into a plan sifter 15 according to FIG. 12. This plan sifter 15 separates the ground product into coarser ground product 21 and finer ground product 22. The coarser ground product 21 is conveyed to the material bed roller mill by means of the return arrangement 8. Finer ground product 22 is discharged from the grinding arrangement 1. The return arrangement used here is a bucket conveyor. Alternatively, however, the use of a chain conveyor as return arrangement is also possible.

FIG. 6 shows a flow chart of an alternative method according to the invention for producing flour 24. Grain 20 is conveyed into a material bed roller mill 16 according to FIG. 9 and is ground there. The ground grain 20 is then conveyed into a plan sifter 15 according to FIG. 12 and is separated there into coarser ground product 21 and a mixture of finer ground product 22 and bran 23. The coarser ground product 21 is returned into the material bed roller mill 16 for grinding again. The mixture of finer ground product 22 and bran 23 is ground again in another material bed roller mill 16. The ground product is thereupon conveyed into a semolina purifier 14 of Bühler AG (Article Number: MQRF-30/200) and is separated there into coarser ground product 21, bran 23 and flour 24. In the process, the coarser ground product 21, which has been separated as finer ground product 22 after the first grinding stage, is conveyed back into the material bed roller mill 16 for grinding again.

FIG. 7 shows a mill diagram according to the invention in a schematic illustration. Grain 20 is conveyed into a material bed roller mill 16 according to FIG. 9 for grinding and, after the grinding, into a detacher 12, which is designed here as an impact detacher according to FIG. 11. The ground product is then conveyed into a further material bed roller mill 16 and is ground again there. The ground product is thereupon conveyed into a plan sifter 15 according to FIG. 12, which separates the ground product into four fractions which each have particles within a defined size range. Each of these four fractions is transported into a separate zigzag sifter 13 according to FIG. 10, in which the bran is removed from the ground product. The remaining ground product is thereupon ground in a further material bed roller mill 16, fed to a further detacher 12 and thereupon separated in a further plan sifter 15 into at least two, three, four or even five fractions. Said fractions can be ground again in material bed roller mills 16 or else can also be conveyed into zigzag sifters 13 for the separation of bran. In addition, the mill diagram has cyclone separators 18 for the further separation of bran from an air flow of a zigzag sifter 13.

FIG. 8 shows an additional schematic illustration of a grinding plant 1 according to the invention. The same reference numerals in FIG. 1 and FIG. 8 designate the same components here.

This grinding plant substantially corresponds to the grinding plant according to FIG. 1 and additionally has a sensor 31 for measuring the force exerted on the rollers 10 by the grain 20 in the roller gap W of thickness s and a compactor 19. The sensor 31 is connected to a closed-loop control device 30 for transmitting the measured forces to this closed-loop control device 30. Furthermore, the closed-loop control device 30 is connected to the drive of the rollers 10 for setting the rotary speed of the rollers. In order to avoid excessive heating of the grain 20 by the grinding operation, the force which is exerted on the rollers 10 by the quantity of grain 20 in the roller gap W is measured. If the measured force on the rollers 10 now increases due to, for example, a greater feed of grain 20 from the compactor 19, more heat is introduced into the grain 20 by the grinding operation in the grinder 2, a factor which can lead to changes in or damage to the proteins, in particular gluten, in the grain 20. By means of the force measured by the sensor 31, the rotary speed of the rollers can now be reduced by the closed-loop control device 30 in such a way that the measured force on the rollers 10 again reaches a desired value. This can ensure that an excessive amount of heat is not introduced into the grain 20 by the grinding operation and that the grinder 2 is also not damaged.

The further method for producing flour corresponds to the method already described with respect to FIG. 1.

FIG. 9 shows a schematic illustration of a material bed roller mill 16 having two rollers 10. In the material bed roller mill 16, grain 20 is drawn in by the opposed rotation r of the two rollers 10, such that a material bed situation arises in the roller gap W. A force F of 300 kN is exerted on the rollers 10 having a diameter D of 250 mm and a length of 1000 mm, such that a specific grinding force of 1.2 $N/mm^2$ is achieved. The ground grain 20 contains coarser ground product 21, finer ground product 22 and bran 23. This ground product is compacted by the grinding in the material bed roller mill 16, such that said ground product, before separation in a separating stage (not shown here), has to be detached into individual particles in a detacher, as shown, for example, according to FIG. 11.

FIG. 10 shows a zigzag sifter 13 having an inlet 41 for a mixture of finer ground product 22 and bran 23 to be separated. An air flow 40 is directed along the axis of the zigzag sifter and set in such a way that the bran 23, which has a lower density than the finer ground product 22, is blown out through the bran outlet 42. The heavier ground product 22 falls in the zigzag sifter 13 in such a way that said ground product 22 is conveyed out of the zigzag sifter 13 through the semolina outlet. Here, the "outflow velocity" of the air flow 40 is within the range of 0.7 m/s to 2.5 m/s, depending on the material to be separated.

FIG. 11 shows an impact detacher 12 having an impact detacher inlet 50, rotors 51 and an impact detacher outlet 52. Compacted grain 53 is conveyed into the impact detacher 12 and strikes the rotors 51 there, which detach the compacted grain, inter alia, by the impact, such that grain 54 detached substantially into individual particles is formed. This detaching can be effected in a plurality of stages by rotors 51 connected one after the other, for example two to six rotors 51, wherein two rotors 51, which are attached to a shaft 55, are shown here. The rotors 51 have such a shape that the grain is conveyed to the impact detacher outlet 52.

FIG. 12 shows a plan sifter 15 having a coarse sieve 61, a medium sieve 62 and a fine sieve 63. Ground grain 20, which contains coarser ground product, finer ground product 22 and bran 23, is conveyed into the plan sifter 15, such that the ground grain can be separated into a plurality of fractions of different size. The coarse sieve 61 has a mesh size of 1120 μm, the medium sieve 62 a mesh size of 560 μm and the fine sieve 63 a mesh size of 280 μm. The ground grain 20 is therefore separated into three fractions, wherein the first fraction has a size range of 1160 μm to 560 μm, the second fraction a size range of less than 560 μm to 280 μm, and the third fraction a size range of less than 280 μm. Here, the first fraction and the second fraction are classified as coarser ground product 21 and contain bran 23. These two fractions are thereupon conveyed according to FIG. 1, for example, into a material bed roller mill. The third fraction, which contains finer ground product 22 and bran 23, is conveyed according to FIG. 1, for example, into a zigzag sifter according to FIG. 10 for separating the bran.

The invention claimed is:

1. A method for grinding cereal grain to produce flour and/or semolina from said cereal grain in a cereal grain material bed roller mill, the method comprising the steps of:

setting a pressure exerted on rollers of said cereal grain material bed roller mill in a direction of a roller gap between said rollers of said cereal grain material bed roller mill, wherein a specific grinding force of less than 3 $N/mm^2$ is set;

configuring said cereal grain material bed roller mill such that said roller gap is variable during said grinding, whereby, during said grinding, said roller gap varies in such a way that an increase in a volume of said cereal grain in said roller gap leads to an increase in said roller gap;

providing a surplus of said cereal grain via a filled material duct or hopper, thereby producing a material bed of said cereal grain in a draw-in region immediately upstream of said roller gap;

rotating said rollers at different speeds;

drawing said cereal grain into said roller gap by said rollers from said material bed to form a packed particle fill in said variable roller gap between said rollers; and grinding said cereal grain in said packed particle fill of said cereal grain in said variable roller gap to produce said flour and/or semolina;

wherein said cereal grain material bed roller mill comprises said rollers, at least one feed opening, said draw-in region upstream of said rollers, said variable roller gap between said rollers and at least one delivery opening.

2. The method as claimed in claim 1, wherein said cereal grain is bread wheat, durum wheat, maize or buckwheat.

3. The method as claimed in claim 1, wherein said pressure set on said rollers in the direction of said roller gap is set so that said cereal grain is heated, during grinding, by less than 59° F. (15° C.).

4. The method as claimed in claim 1, wherein said variable grinding roller gap remains larger than a particle size of a majority of said cereal grain.

* * * * *